US006869576B2

(12) United States Patent
Espeillac et al.

(10) Patent No.: US 6,869,576 B2
(45) Date of Patent: Mar. 22, 2005

(54) PROCESS FOR HYDROTREATING A HYDROCARBON FEEDSTOCK AND APPARATUS FOR CARRYING OUT SAME

(75) Inventors: Marcellin Espeillac, Viroflay (FR); Pierre Crespin, Le Havre (FR)

(73) Assignee: Total Raffinage Distribution S.A., Puteaux (FR)

( * ) Notice: Subject to any disclaimer, the term of this patent is extended or adjusted under 35 U.S.C. 154(b) by 474 days.

(21) Appl. No.: 09/751,512

(22) Filed: Dec. 29, 2000

(65) Prior Publication Data

US 2001/0001036 A1 May 10, 2001

Related U.S. Application Data

(62) Division of application No. 09/001,486, filed on Dec. 31, 1997, now Pat. No. 6,217,749.

(30) Foreign Application Priority Data

Dec. 31, 1996 (FR) ..... 96 16290

(51) Int. Cl.[7] ..... B01J 8/00; C07C 5/00

(52) U.S. Cl. ..... 422/189; 422/187; 422/188; 208/208 R; 208/209

(58) Field of Search ..... 422/187, 188, 422/189; 196/111, 133; 202/158; 208/208 R, 209, 210, 212, 251 H, 254 H

(56) References Cited

U.S. PATENT DOCUMENTS 1,707,349 A * 4/1929 Egloff ..... 208/100
3,314,879 A * 4/1967 Lacy et al. ..... 208/356
3,437,584 A * 4/1969 Hamblin ..... 208/93
3,519,557 A * 7/1970 Pruiss ..... 208/143
3,544,428 A * 12/1970 Mellbom ..... 196/111
3,591,489 A * 7/1971 Adams et al. ..... 208/211
5,705,052 A * 1/1998 Gupta ..... 208/57
5,720,872 A * 2/1998 Gupta ..... 208/57

* cited by examiner

*Primary Examiner*—Hien Tran
*Assistant Examiner*—Jennifer A. Leung
(74) *Attorney, Agent, or Firm*—Frommer Lawrence & Haug LLP; A. Thomas S. Safford

(57) ABSTRACT

A process for hydrotreating a hydrocarbon feedstock (1) involving the use of at least one hydrotreatment, particularly hydrodesulfurization, reactor (2) and a fractionation unit (3), which latter contains two distinct injection zones (4, 5) for the hydrocarbon feedstocks, a common zone (8) of vaporization of the light fractions and two distinct draw-off lines (6, 7) for the liquid bottoms; the hydrocarbon feedstock (1) being subjected to a preliminary treatment either in a first hydrodesulfurization reactor (20) the operating conditions of which (P, T, LHSV) may be different from those of the hydrotreatment reactor (2), or in a sweetening apparatus or else in a sulfur trap, the hydrocarbon feedstock being then injected into the first injection zone (4) of the fractionation unit (3), the liquid bottoms being removed through the draw-off line (6) of the injection zone (4) and passed into a hydrotreatment reactor (2), the effluents from said reactor (2) being injected into a second injection zone (5) of the fractionation unit (3), the light fractions leave the common zone (8) through an evacuation line (11), and the heavy liquid bottoms of the second injection zone (5) being removed through the corresponding draw-off line (7). Also apparatus for carrying out this process.

11 Claims, 2 Drawing Sheets

PROCESS FOR HYDROTREATING A HYDROCARBON FEEDSTOCK AND APPARATUS FOR CARRYING OUT SAME

RELATED APPLICATION

This application is a divisional of U.S. application Ser. No. 09/001,486, filed Dec. 31, 1997, now U.S. Pat. No. 6,217,749. This application claims priority to French Application No. 96 16290, filed Dec. 31, 1996, which is incorporated herein by reference.

FIELD OF INVENTION

The present invention concerns a process for hydrotreating a hydrocarbon feedstock, said process involving at least one hydrotreatment reactor, and the apparatus for carrying out said process.

BACKGROUND OF THE INVENTION

Hydrotreatment or hydrorefining processes have assumed a very important place in the refining of petroleum products. Petroleum and petroleum fractions are very complicated mixtures which besides hydrocarbons contain various compounds mostly containing sulfur, nitrogen, oxygen and metals such as, in particular, nickel and vanadium. These compounds vary in quantity and nature, depending on the origin of the crude petroleum. They are harmful impurities affecting the good quality of petroleum products in terms of pollution, corrosion, odor and stability.

Hydrotreatment reactions include mainly hydrodesulfurization (HDS), hydrodeazotization (HDN), hydrodeoxygenation (HDO) and hydrodemetallization (HDM) as well as the hydrogenation of unsaturated groups (olefins, aromatics) and hydrocracking. They take place in the presence of specific catalysts, particularly based on oxides and sulfides of metals such as cobalt, nickel or molybdenum on an alumina support at high hydrogen pressure and elevated temperatures (>300° C.).

A description of industrial conditions for carrying out hydrorefining processes and particularly hydrodesulfurization can be found, for example, in volume 1 of the book by P. Wuithier on "Petroleum, Refining and Chemical Engineering", pages 816 to 831, published by Editions Technip.

More particularly, the petroleum industry is confronted with the problem of eliminating sulfur compounds contained in crude petroleum used in refining. The sulfur content of this petroleum (expressed in wt %) can range from 0.14 to 0.8% for low-sulfur crudes (LSC) and from an average of 1.75 to 2.5% for medium and high-sulfur crudes (MSC and HSC). From this it follows that the various products obtained by straight-run distillation of such a crude petroleum or by a particular treatment thereof or of its distillates (for example pyrolysis, thermal or catalytic cracking) have sulfur contents that are incompatible with the specifications or regulations in effect in industrial countries.

Hydrodesulfurization reactions are characterized by the breaking of C—S bonds of sulfur derivatives contained in the petroleum, such as the mercaptans, sulfides and thiophene compounds. The sulfur is eliminated by chemical reaction with hydrogen resulting in the formation of hydrogen sulfide, $H_2S$. The desulfurization reactions are complete (no equilibrium is involved], exothermic, hydrogen-consuming and, for aromatic compounds, slow. The most widely used industrial catalysts are of the Co—Mo (cobalt-molybdenum) and Ni—Mo (nickel-molybdenum) type on an alumina support.

According to the present invention, the petroleum feedstocks or fractions to be treated can vary and include, for example, in particular:

- overhead cuts of atmospheric distillation such as liquefied petroleum gas (LPG) and light gasoline (boiling temperature ranging from 0 to 80–100° C.) and which contain small amounts of easily removable sulfur;
- naphtha (boiling temperature from 100 to 185° C.) intended for catalytic reforming with highly sulfur-sensitive catalysts, and gasolines from catalytic cracking;
- kerosene cut (185 to 220–240° C.) used for making jet fuel and which contains mercaptans and thiophenes; this cut is treated by mild hydrotreatment or by sweetening, for example using the MEROX process (mercaptan oxidation);
- gas oil cut (240 to 370° C.) intended mainly for making extra low-sulfur diesel oil and domestic fuel oil and which contains, in particular, benzothiophenes and dibenzothiophenes (heavy gas oil cut boiling at 320–370° C.) which are increasingly difficult to eliminate;
- vacuum distillation cuts, highly resistant to desulfurization.

A known desulfurization process used industrially for hydrocarbons, for example gas oil, generally comprises the following steps: the feedstock is mixed with hydrogen-rich gas and compressed in preliminary fashion. This feedstock is heated by a furnace and introduced at about 350° C. into a fixed bed reactor containing Co—Mo-type catalyst, at a pressure of about 50 bar and a partial hydrogen pressure of 30 bar. The reaction effluent consisting of liquid and gas is passed into a high-pressure separator from which the hydrogen-rich vapor phase is recycled, while the liquid phase is passed into a steam stripper which separates overhead a gas rich in $H_2S$ (to be subjected to sulfur extraction) and the light hydrocarbons (raw gasoline) and leaves the desulfurized gas oil as bottoms.

The problem facing the refining industry and consisting of increasingly stringent specifications concerning the sulfur content of the products has been partly solved by markedly increasing the volume of catalyst used. In practice, this means the addition of several reactors in series which makes it possible to attain, for example for extra low-sulfur diesel oil, a degree of desulfurization of about 95 to 98%. Although this is an optimal process, fractionation is required after each reactor to eliminate, in particular, the $H_2S$ formed during the desulfurization, which if introduced into the following reactor would negatively influence its desulfurization yield, and to remove the fractions of the effluents from the preceding reactor whose sulfur content meets specifications, so as not to saturate unnecessarily the capacity of the following reactor. All this would markedly increase costs.

It is also known, particularly from International Patent Application WO 94/09090 (Mobil) to use a process for improving the quality of naphtha and light gasoline cuts obtained by catalytic cracking and containing high amounts of sulfur compounds. This process comprises a first sweetening step (by mercaptan oxidation), then a fractionation step which separates the effluents into a fraction of low boiling point, free of mercaptans, and a fraction of higher boiling point having a high content of sulfur and thiophene compounds. This second fraction is then subjected to hydrodesulfurization in a reactor, followed, in another reactor, by an octane content restoration step with an acidic catalyst, without intermediate fractionation. The mercaptans can be removed from the effluents of the second reactor in an extraction unit. In other words, such an installation is complicated and costly.

There is a solution whereby the $H_2S$ gas formed is extracted between two reactors, but this process is expensive. Such a process is proposed in International Patent Application WO 96/17903 (Davy Process Technology) which describes a two-stage hydrodesulfurization process of a hydrocarbon feedstock comprising stripping the effluents leaving the reactor or reactors of the first stage with a hydrogen-containing recycled gas so as to separate the $H_2S$ formed during desulfurization from the liquid fraction which is passed on to the second stage.

Nevertheless, it appeared that the efficacy of such desulfurization processes could still be markedly improved, particularly in economic terms.

U.S. Pat. No. 3,437,584 concerns a process for converting a relatively heavy hydrocarbon feedstock, for example a vacuum distillation residue such as tar, which process comprises introducing said feedstock into a first bottom zone of a distillation (and fractionation) column equipped with a vertical partition extending from the bottom, removing the feedstock distillation residue from this first zone and passing it into a first hydroconversion reactor, introducing the liquid effluents from said reactor into a second, separate bottom zone of said distillation column and removing a distillation residue separately from said second bottom zone. The light fractions removed overhead from said distillation column are passed into a second conversion reactor (possibly a hydrodesulfurization reactor).

This patent does not provide for a preliminary treatment of the feedstock before it enters the distillation column. Moreover, part of the liquid fraction of the effluents from the first conversion (cracking) reactor which is removed from an additional separator 27 is recycled through line 39 to the first reactor together with the heavy hydrocarbons removed from the bottom of the distillation column at 22.

U.S. Pat. No. 4,713,167 relates to a hydrocracking process of a heavy hydrocarbon feedstock which comprises passing said feedstock into a first hydrocracking reactor, passing the reactor effluents to a fractionation unit, recycling the heavier part of the effluents and re-introducing them into the first reactor while passing a less heavy part of the effluents into a second hydrocracking reactor the effluents from which then being mixed with those of the first reactor.

The fractionation unit does not have two distinct zones that would make it possible separately to collect the effluents from the two reactors and to have separate draw-off lines for the distillation residues corresponding to these effluents. Moreover, these are hydrocracking and not hydrotreating (and certainly not desulfurization) processes.

SUMMARY OF THE INVENTION

An original solution permitting to solve the problems of capacity limitation of hydrotreatment reactors was thus found to be particularly interesting in that it involves a preliminary treatment of the feedstock and uses special fractionation.

Surprisingly, in fact, according to the invention, we have now found that the use of a preliminary treatment of the feedstock and the utilization of a fractionation unit, which allow simultaneous distillation of several hydrocarbon feedstocks and are arranged so as to separate the liquid bottoms of each of these feedstocks, make it possible to improve the quality of the final products and, in particular, to reduce their sulfur content without excessively increasing the cost of reactor operation.

Because the transformation of such a unit is relatively easy to bring about, the present invention thus relates to a simple process which can be used in pre-existing installations and requires only minimal adaptation so that the required investment cost is kept at a minimum.

More particularly, the invention relates to a process for hydrotreating a hydrocarbon feedstock by using at least one hydrotreatment reactor and a fractionation unit, said unit comprising two distinct zones for the injection of the hydrocarbon feedstock, a common zone of vaporization of the light fractions and two distinct draw-off lines for the liquid bottoms.

Said process is characterized in that:

- the hydrocarbon feedstock is subjected to a preliminary treatment either in a first hydrodesulfurization reactor whose operating conditions (P, T, LHSV) may be different from those of the hydrotreatment reactor, or in a sweetening apparatus or else in a sulfur trap,
- after said preliminary treatment, the hydrocarbon feedstock is injected into the first injection zone of the fractionation unit,
- the liquid bottoms are removed through the draw-off line of the first injection zone and passed into a hydrotreatment reactor,
- the effluents from said reactor are injected into a second injection zone of the fractionation unit,
- the light fractions leave the common zone through an evacuation line, and
- the heavy liquid bottoms of the second injection zone are removed through the corresponding draw-off line.

In particular, the hydrotreatment reactor is a hydrodesulfurization reactor.

According to a particular embodiment of the invention, the hydrocarbon feedstock can be a gasoline, kerosene, gas oil or vacuum distillation cut.

According to a preferred embodiment of the invention, the liquid bottoms leaving said injection zones of the fractionation unit are isolated from one another by means of a partition disposed inside the fractionation unit.

According to another embodiment, the partition is vertical or horizontal.

Preferably, the light distillates or fractions leaving the common zone through the evacuation line have a sulfur content that is lower than or equal to a predetermined limit value. Thus, only the fraction having a sulfur content that must be corrected is sent to the hydrotreatment reactor, and this results in space savings.

Advantageously, the entering hydrocarbon feedstock is subjected to a preliminary treatment either in a second hydrodesulfurization reactor whose operating conditions (pressure, temperature, hourly space velocity of the feedstock or LHSV, catalyst type etc.) may be different, or in a sweetening apparatus or else in a sulfur trap.

Advantageously, the light distillates or fractions leaving the fractionation unit through an overhead evacuation line are treated in a specific reactor depending on their residual content of sulfur or aromatics they contain. The catalyst used in said reactor is different from that of the first reactor and is based on platinum or is of the thioresistant (sulfur-resistant) type.

The invention also concerns an apparatus for hydrotreating a hydrocarbon feedstock including at least one hydrotreatment reactor, a fractionation unit disposed between the inlet for said hydrocarbon feedstock and said hydrotreatment reactor, and lines for carrying the effluents of the hydrocarbon feedstock and the effluents from the hydrotreatment reactor to the fractionation unit, said fractionation unit comprising separation means defining two distinct zones. Said system is characterized in that:

the fractionation unit is preceded by a hydrodesulfurization or sweetening reactor whose line for carrying the hydrocarbon feedstock effluents ends in one of these two distinct zones, whereas the line for carrying the effluents from the hydrotreatment reactor ends in the other of these zones, and in that the fractionation unit has two different draw-off lines through which are removed, respectively, the liquid bottoms of the hydrocarbon feedstock effluents and the effluents from the reactor.

In an advantageous embodiment of the invention, the separation means consist of a vertical partition extending from the bottom of the fractionation unit. Advantageously, said partition consists of a cylindrical element disposed inside and preferably concentrically with the vertical wall of the fractionation unit. The partition can also consist of a wall disposed in a plane paralleling the longitudinal axis of the fractionation unit.

According to another embodiment of the invention, the separation means are horizontal and the two lines for carrying, respectively, the hydrocarbon feedstock and the effluents from the reactor end at different heights of the fractionation unit.

Preferably, the horizontal separation means consist of a tray provided with at least one riser.

Advantageously, the fractionation unit can be disposed between two hydrodesulfurization reactors or between a sweetening reactor and a hydrodesulfurization reactor. Moreover, it can feed, by overhead evacuation of light distillates or fractions, another reactor with a more specific action, depending on the residual content of sulfur and of aromatic compounds of said fractions.

BRIEF DESCRIPTION OF THE DRAWINGS

In this specification and in the accompanying drawings, we have shown and described preferred embodiments of the invention and have suggested various alternatives and modifications thereof; but it is to be understood that these are not intended to be exhaustive and that many other changes and modifications can be made within the scope of the invention. The suggestions herein are selected and included for purposes of illustration in order that others skilled in the art will more fully understand the invention and the principles thereof and will thus be enabled to modify it in a variety of forms, each as may be best suited to the conditions of a particular use.

DETAILED DESCRIPTION OF PREFERRED EMBODIMENTS

Figure 1:
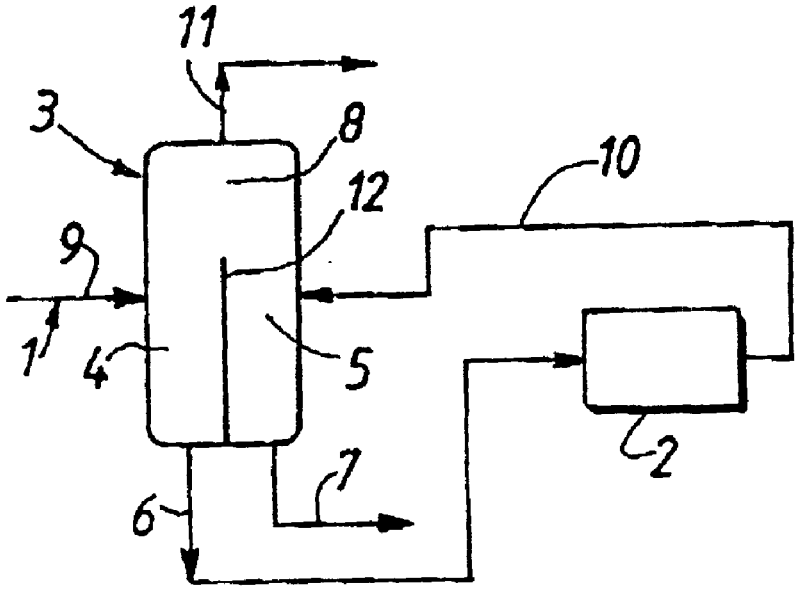
FIG. 1 (Prior art)
FIG. 1 is a schematic representation of an apparatus according to the invention (as broadly conceived by the applicants.

The hydrotreatment apparatus shown schematically in FIG. 1 contains essentially a fractionation unit or column 3 of cylindrical shape provided with trays similar to those of a distillation column and fitted with a partitioning element 12 extending vertically from the bottom of the column to a certain height in the form of a wall disposed in a plane parallel to the longitudinal axis of said column. This disposition makes it possible to partition the corresponding volume of said column 3 into two distinct, separated injection zones 4 and 5 and a common upper vaporization zone 8 for the light distillates or fractions. The hydrocarbon feedstock 1 to be treated is introduced through line 9 into the first distinct zone 4 of fractionation column 3 the operation of which is adjusted so as to remove through line 11 the overhead distillates or fractions having a predetermined final distillation point and a sulfur content conforming to a fixed value or to a value that is lower than or equal to a predetermined value. The liquid bottoms of feedstock 1 are removed from the bottom of zone 4 through line 6 and are passed to a hydrodesulfurization reactor 2 whose operating conditions [pressure, temperature, type of catalyst used, $H_2$/feedstock volume ratio, namely the ratio of the hourly rate of treatment hydrogen in $Nm^3$ (normal $m^3$)/h to the hourly rate of the feedstock in $m^3$/h and liquid hourly space velocity of the feedstock (LHSV), namely the ratio of the hourly rate of the feedstock in $m^3$/h to the volume of catalyst in $m^3$]] are determined as a function of the nature of feedstock 1 and its sulfur content. The effluents from said reactor 2 are injected through line 10 into the second distinct zone 5 of fractionation column 3, part of said effluents being removed in the form of light distillate or fraction through line 11, whereas the corresponding liquid bottoms are removed through line 7. These bottoms can also have a low sulfur content, as indicated by the examples given in the following.

Figure 2:
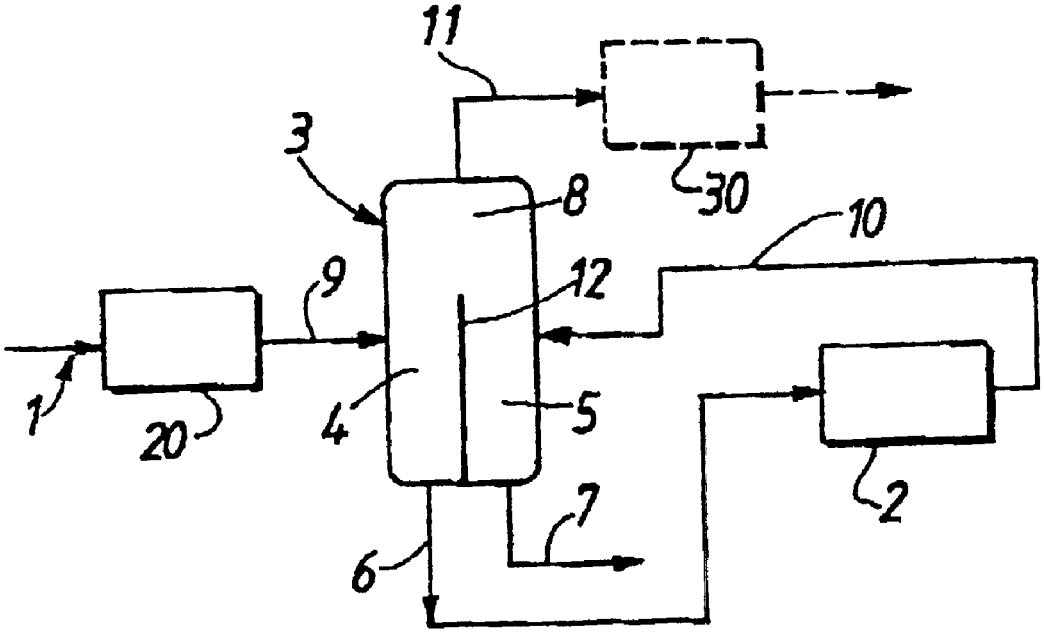
FIG. 2 is a schematic representation of an apparatus according to the invention, as broadly conceived by the applicants.

FIG. 2 represents a hydrotreatment system according to the invention which differs from the preceding one only in that hydrocarbon feedstock 1 undergoes a preliminary treatment in reactor 20, the effluents from said reactor being introduced through line 9 into the first zone 4 of fractionation column 3. Depending on the nature of feedstock 1, reactor 20 can also be a hydrodesulfurization reactor operating under different conditions, or a sweetening reactor or any other system which makes it possible to reduce the sulfur content (sulfur trap). In addition, a third, optional reactor 30, represented with broken lines, permits a more specific treatment of light distillates or fractions coming from fractionation unit 3 through evacuation line 11, for example depending on the residual content of sulfur or of aromatic compounds (for example, benzene), by using appropriate catalysts (particularly platinum or thioresistant catalysts).

Figure 3:
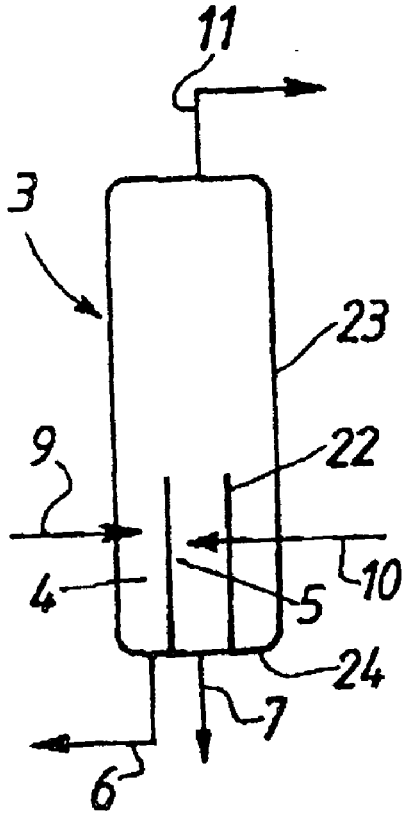
FIGS. 3 and 4 represent two variants of the fractionation unit showing other embodiments of the partition of the fractionation unit.

FIG. 3 represents a first variant of the partition of fractionation column 3 consisting of a cylindrical element 22 disposed inside and concentrically with wall 23 of column 3 and extending from bottom 24 of said column to a certain height so as to define a distinct first zone 4 receiving through line 9 the hydrocarbon feedstock or its effluents after they have passed through a reactor (not shown, but identical to reactor 20 of FIG. 2), and a second distinct zone 5 receiving through line 10 the effluents from the hydrotreatment reactor (not shown, but identical to reactor 2 of FIGS. 1 and 2). The liquid bottoms of said two zones 4 and 5 are removed, respectively, through lines 6 and 7, the bottoms removed through line 6 feeding the hydrotreatment reactor. Note that feeding lines 9 and 10 can be inverted relative to zones 4 and 5 without affecting the operation of fractionation column 3, provided the corresponding draw-off lines 6, 7 are also inverted.

Figure 4:
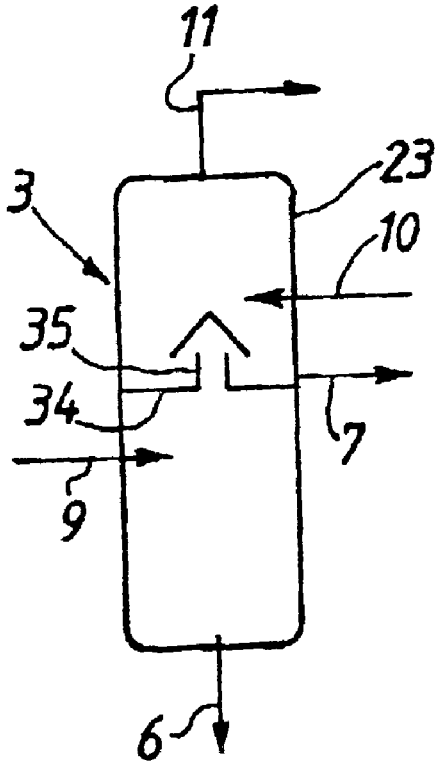

FIG. 4 represents a second variant of the partition of fractionation column 3 consisting of tray 34 disposed horizontally and in circular and tight contact with wall 23 of column 3. Said tray is fitted with a riser 35 permitting passage of the light distillates or fractions of the hydrocarbon feedstock introduced through line 9 into the zone of column 3 that is situated below tray 34, and their overhead removal through evacuation line 11. Moreover, said tray 34 permits the separation from the liquid bottoms of the hydrocarbon feedstock introduced through line 9 the liquid bottoms coming from the effluents of a reactor that is not shown (but is like reactor 2 of FIGS. 1 and 2) and introduced through line 10 into a zone of column 3 situated above tray 34, and the removal of said bottoms through line 7. Note also that the hydrocarbon feedstock can be introduced through line 9, into the zone of column 3 situated above tray 34, and that the effluents coming from the reactor can be introduced through line 10 below tray 34 without affecting the operating efficacy of column 3, provided that the draw-off lines 6 and 7 are inverted.

It is also possible to envisage, without exceeding the scope of the invention, a hydrotreatment apparatus that does not differ from the one described and illustrated by FIG. 2 and wherein reactor 2 is configured to have a more specific dearomatization action (by using a platinum or thioresistant catalyst) or dewaxing action, so as to treat feedstocks 1 which can be, in particular, naphthas from catalytic cracking and to remove through line 7 a cut for jet fuel conforming to specifications.

The Examples below illustrate the invention.

EXAMPLE 1

A large cut obtained from a Brent crude and having an initial distillation point of 150° C. and a final distillation point of 360° C. and a 0.12 wt % sulfur content was used. This cut was introduced, according to FIG. 1, through line 9 into a first zone 4 of a fractionation unit 3 from which was removed through line 11 an overhead fraction having an initial distillation point of 240° C. and a sulfur content of less than 0.018 wt %. This fraction was used as base for a VLSC (very low sulfur content) gas oil. Through line 6, the liquid bottoms having an initial boiling point of 220° C. and a sulfur content of 0.2 wt % were removed from the first zone 4. This fraction was then treated in a hydrodesulfurization reactor 2 under the following operating conditions:

catalyst: NiMo HR 348, supplied by Procatalyse temperature: 340° C.

pressure: 50 bar $H_2$/feedstock volume ratio: 150 $Nm^3/m^3$

[liquid] hourly space velocity (LHSV): 1.5 $h^{-1}$

The effluents from this reactor were injected through line 10 into the second distinct zone 5 of fractionation unit 3, part of said effluents being recovered in the form of distillate through line 11 at the top of fractionation unit 3. This fraction had an initial distillation point of 220° C., a final distillation point of 360° C. and a sulfur content of 0.004 wt % (40 ppm) permitting it to be used as city gas oil.

By comparison, to obtain such pronounced desulfurization of the same cut without using fractionation such as that mentioned hereinabove, and under the same operating conditions of the hydrodesulfurization reactor (in particular: LHSV=$1.5^{-1}$ h), a 60% larger catalyst volume would have to be used.

EXAMPLE 2

The feedstock used in this example was a straight-run gas oil cut having a sulfur content of 1.2 wt %, an initial distillation point of 150° C. and a final distillation point of 380° C.

This feedstock was introduced, according to FIG. 2, into a first hydrodesulfurization reactor 20 operating under the following conditions:

catalyst: NiMo HR 348, supplied by Procatalyse temperature: 370° C.

pressure: 45 bar $H_2$/feedstock volume ratio: 200 $Nm^3/m^3$

[liquid] hourly space velocity (LHSV): 2 $h^{-1}$

The effluent from the reactor was introduced through line 9 at a temperature of 370° C. into a first zone 4 of fractionation unit 3 from which was recovered through line 11 an overhead fraction with an initial distillation point of 130° C., containing less than 0.03 wt % of sulfur and having the composition of gas oil. Liquid bottoms having an initial distillation point of 300° C. and containing 0.3 wt % of sulfur were also recovered, through line 6.

These bottoms were passed through line 6 to the inlet to the second hydrodesulfurization reactor 2 operating under the following conditions:

catalyst: NiMo HR 348, supplied by Procatalyse temperature: 360° C.

pressure: 40 bar $H_2$/feedstock volume ratio: 150 $Nm^3/m^3$

[liquid] hourly space velocity (LHSV): 1.5 $h^{-1}$

The effluents from reactor 2 containing 0.025 wt % of sulfur were recovered through line 10 and injected into the second distinct zone 5 of fractionation unit 3. Part of these effluents was recovered in the form of distillate through line 11. Moreover, the liquid bottoms of said second zone 12 were removed through line 7, said fraction having an initial distillation point of 300° C. and a final distillation point of 380° C. and containing 0.027 wt % of sulfur. This product is suitable as a gas oil base.

By comparison, to achieve an equally efficient desulfurization of the same gas oil cut in an installation comprising reactors 20 and 2 in series and operating under the same conditions as hereinabove, with a conventional fractionation unit inserted between them, it would be necessary to add a second fractionation unit after the second reactor, particularly a stripper. It is thus evident that the apparatus according to the invention has important economic advantages.

EXAMPLE 3

The feedstock used was a straight-run distillation cut having an initial distillation point of 145° C. and a final distillation point of 300° C. and a sulfur content of 0.5 wt %, partly consisting of mercaptans present in the forerun.

This feedstock was introduced, according to FIG. 2, into a first sweetening reactor 20 (mercaptan oxidation on a fixed [catalyst] bed).

The effluent from the reactor was introduced through line 9 into a first zone 4 of a fractionation unit 3 from which, through line 11, was recovered an overhead fraction having an initial distillation point of 140° C. and containing less than 0.1 wt % of sulfur and which is suitable as jet fuel.

Through line 6 were removed the liquid bottoms having an initial distillation point of 230° C. and containing 0.8 wt % of sulfur, the mercaptans having been converted into disulfides in the first reactor, and said disulfides having been entrained into said heavy bottoms fraction. This fraction was introduced into a hydrodesulfurization (HDS) reactor 2 operating under the following conditions:

catalyst: CoMo HR 316, supplied by Procatalyse temperature: 320° C.

pressure: 35 bar $H_2$/feedstock volume ratio: 100 $Nm^3/m^3$

[liquid] hourly space velocity (LHSV): 4 $h^{-1}$

The effluents from this reactor, containing 0.02 wt % of sulfur, were recovered through line 10 and injected into a second distinct zone 5 of fractionation unit 3, part of these effluents being recovered in the form of distillate through line 11 at the top of fractionation unit 3. The liquid bottoms in said second zone 5, with an initial distillation point of 230° C., a final distillation point of 300° C. and 0.025 wt % of sulfur, were removed through line 7. This fraction is suitable as gas oil base.

As in Example 2, to achieve equally pronounced desulfurization of the same cut by use of conventional intermediate fractionation and identical fractionation conditions of the sweetening and hydrodesulfurization reactors, it would be necessary to add a stripping-type fractionation unit downstream from the second reactor. This shows the economic value of the process according to the invention.

What is claimed is:

1. Apparatus for hydrotreating a hydrocarbon feedstock comprising:

a hydrocarbon feedstock supply, a desulfurization reactor fed by said supply, at least one separate hydrotreatment reactor, a fractionation unit disposed between the desulfurization reactor and the at least one hydrotreatment reactor, said fractionation unit containing separation means comprising an internal partitioning structure defining two distinct injection zones in flow communication with a common upper vaporization zone, an evacuation line for withdrawal downstream of light fractions from the vaporization zone, said fractionation unit having separate lines for carrying respectively the effluents from the desulfurization reactor and the effluents from the at least one hydrotreatment reactor to the fractionation unit, with one of said lines carrying the effluents from the desulfurization reactor into one of said injection zones, and the other of said lines carrying the effluents from the at least one hydrotreatment reactor into the other of said injection zones, the fractionation unit having two different draw-off lines through which are removed, from the injection zones respectively, the liquid bottoms of the effluents of the desulfurization reactor that are passed on to the at least one hydrotreatment reactor and separately of the effluents from the at least one hydrotreatment reactor that are passed on downstream.

2. Hydrotreatment apparatus according to claim 1, wherein the desulfurization reactor is a hydrodesulfurization or a sweetening reactor.

3. Hydrotreatment apparatus according to claim 1, further comprising a separation means, wherein the separation means is a vertical partition extending from a bottom of the fractionation unit.

4. Hydrotreatment apparatus according to claim 3, wherein the partition consists of a cylindrical element disposed inside a vertical wall of the fractionation unit.

5. Hydrotreatment apparatus according to claim 1, further comprising a separation means, wherein the separation means is horizontal extending from a vertical wall of the fractionation unit and wherein the separate lines carrying, respectively, the effluents from the desulfurization reactor and from the at least one hydrotreatment reactor end at different heights of the fractionation unit respectively above and below the separation means.

6. Hydrotreatment apparatus according to claim 5, wherein the separation means is a tray provided with at least one riser.

7. Hydrotreatment apparatus according to claim 1, wherein the at least one hydrotreatment reactor is a hydrodesulfurization reactor.

8. Hydrotreatment apparatus according to claim 2, wherein the at least one hydrotreatment reactor is a hydrodesulfurization reactor.

9. Apparatus according to claim 1, further comprising another reactor wherein said light fractions removed from the fractionation unit through the evacuation line are treated depending on the residual content of sulfur or aromatic compounds of said light fractions.

10. Apparatus according to claim 7, further comprising another reactor wherein said light fractions removed from the fractionation unit through the evacuation line are treated depending on the residual content of sulfur or aromatic compounds of said light fractions.

11. Hydrotreatment apparatus according to claim 3, wherein the partition consists of a cylindrical element disposed concentrically with a vertical wall of the fractionation unit.

* * * * *